US005791980A

United States Patent [19]

Kramer, Jr.

[11] Patent Number: 5,791,980

[45] Date of Patent: Aug. 11, 1998

[54] TELESCOPING EXHAUST TUBE ASSEMBLY

[76] Inventor: Vance M. Kramer, Jr., 26301 Carrington, Perrysburg, Ohio 43551

[21] Appl. No.: 887,802

[22] Filed: Jul. 3, 1997

[51] Int. Cl.[6] ..... F23J 11/04

[52] U.S. Cl. ..... 454/64; 285/302

[58] Field of Search ..... 454/63, 64, 65; 285/302

[56] References Cited

U.S. PATENT DOCUMENTS

| | | | |
|---|---|---|---|
| 358,674 | 3/1887 | Kendall | 454/64 X |
| 3,975,129 | 8/1976 | Kramer, Sr. . | |
| 4,038,913 | 8/1977 | Earley | 454/64 |
| 4,086,847 | 5/1978 | Overmyer . | |
| 4,804,019 | 2/1989 | Kramer, Jr. . | |
| 5,162,017 | 11/1992 | Nordin . | |
| 5,222,906 | 6/1993 | Lundström | 454/64 |
| 5,482,505 | 1/1996 | Hedlund . | |

*Primary Examiner*—Harold Joyce
*Attorney, Agent, or Firm*—Rankin, Hill, Porter & Clark LLP

[57] ABSTRACT

An apparatus for exhausting engine combustion products or the like from an enclosed work space. The apparatus includes an extensible tube assembly adapted to be suspended in the enclosed work space with its upper end connected to an overhead conduit structure. The lower end of the assembly has a tailpipe adaptor for connection to an engine exhaust pipe. The assembly has two or three telescoping tubular sections formed of flexible, helical corrugated tubing, and these are movable between a retracted position and an extended position wherein the lower end may be moved to a variety of positions for connection to an engine exhaust pipe.

8 Claims, 3 Drawing Sheets

TELESCOPING EXHAUST TUBE ASSEMBLY

BACKGROUND OF THE INVENTION

This invention relates to exhaust systems for removing harmful waste gases from enclosed work spaces, such as garages where work is performed on automotive vehicles. More particularly, the invention relates to a flexible, extendible tube assembly adapted to be connected between an engine exhaust pipe or other source of harmful gases, and a duct system that exhausts to outside atmosphere.

Exhaust systems of this type are used in automobile service stations, vehicle inspection stations and other facilities where work on automotive vehicles is performed. These facilities require some means for removing harmful waste gases produced when vehicle engines are operated during service. This is particularly important in order to provide a safe environment for workers in the enclosed space. The use of exhaust ducts and blowers in these situations is generally required, however, the particular problem is to connect an engine exhaust pipe directly to the ducts which are usually located overhead and supported by the ceiling of the work space.

Many devices have been used for this purpose such as lengths of flexible hose, and conduits embedded in the concrete floor. Hoses, however, can be a hazard when laying on the garage floor. Several types of extendable hose devices have been used, such as those shown and described in U.S. Pat. Nos. 4,086,847, 5,162,017, 5,222,906 and 5,482,505. These devices are generally connected at one end directly to an engine exhaust tube or vehicle tailpipe and at the opposite end to overhead duct work. Various means are used to retract the hose to a suspended position spaced well above the floor of the work space. Also, some devices utilize a spring loaded reel for retracting the exhaust hose.

A particular problem with all of these devices, however, is that they are relatively complex and costly to manufacture.

The telescoping tube assembly of the present invention, however, resolves the difficulties referred to above and affords other features and advantages heretofore not obtainable.

SUMMARY OF THE INVENTION

It is among the objects of the invention to provide a retractable tube or hose assembly for use in connecting the tailpipe of an automotive vehicle to a fixed exhaust duct so as to exhaust vehicle engine waste gases from the work space to outside atmosphere.

Another object of the invention is to provide a retractable hose or tube assembly that is of practical design and economical to manufacture.

These and other objects and advantages are obtained with the unique apparatus of the present invention.

The apparatus is designed to exhaust engine combustion products being emitted by a vehicle tailpipe or other exhaust port from an automotive vehicle engine, to fixed duct work through which the combustion products may be conveyed through an outlet port to outside atmosphere.

More particularly, the apparatus comprises an extensible tube assembly adapted to be suspended in the enclosed work space with its upper end operatively connected to an overhead conduit structure. The lower end of the assembly has a tailpipe adaptor thereon adapted to be operatively connected to the engine exhaust pipe or tailpipe. The assembly is adapted for telescoping movement between a retracted position wherein it is suspended well above the floor of the work space and supported by its upper end from overhead duct work, and an extended position wherein the adaptor may be moved to a variety of positions as required, and wherein the assembly is of sufficient length to be conveniently connected to an engine exhaust pipe or tailpipe.

The assembly includes at least two (and preferably three) lengths of flexible, helically corrugated tubing, each succeeding length from top to bottom being of progressively smaller diameter so as to permit a lower length to telescope within the next uppermost length. Each pair of lengths has a first lock ring member with external threads threadedly received in the lower end of the relatively upper member, so that the lower tube length is freely movable axially within the first lock ring member.

A second lock ring member with internal threads is threadedly received on the upper end of the next adjacent lower tube length above the first lock ring member. The second lock ring member is freely movable axially within the relatively upper tube length. The lock ring members thus function to prevent separation of the two tube lengths when the assembly is moved to its extended position.

The assembly is retained in its retracted position when desired by means of retaining means located on the lowermost end of the assembly and cooperating retaining means located on the lock ring member connected to the lower end of the uppermost tube length. Accordingly, the assembly may be stored in a retracted position suspended well above the floor of the work space, but when desired, extended by disconnecting the retaining elements and moving the tailpipe adaptor wherever required for connection to a vehicle engine exhaust tube.

BRIEF DESCRIPTION OF THE DRAWINGS

Referring more particularly to the drawings.

DESCRIPTION OF THE PREFERRED EMBODIMENT

Figure 1:
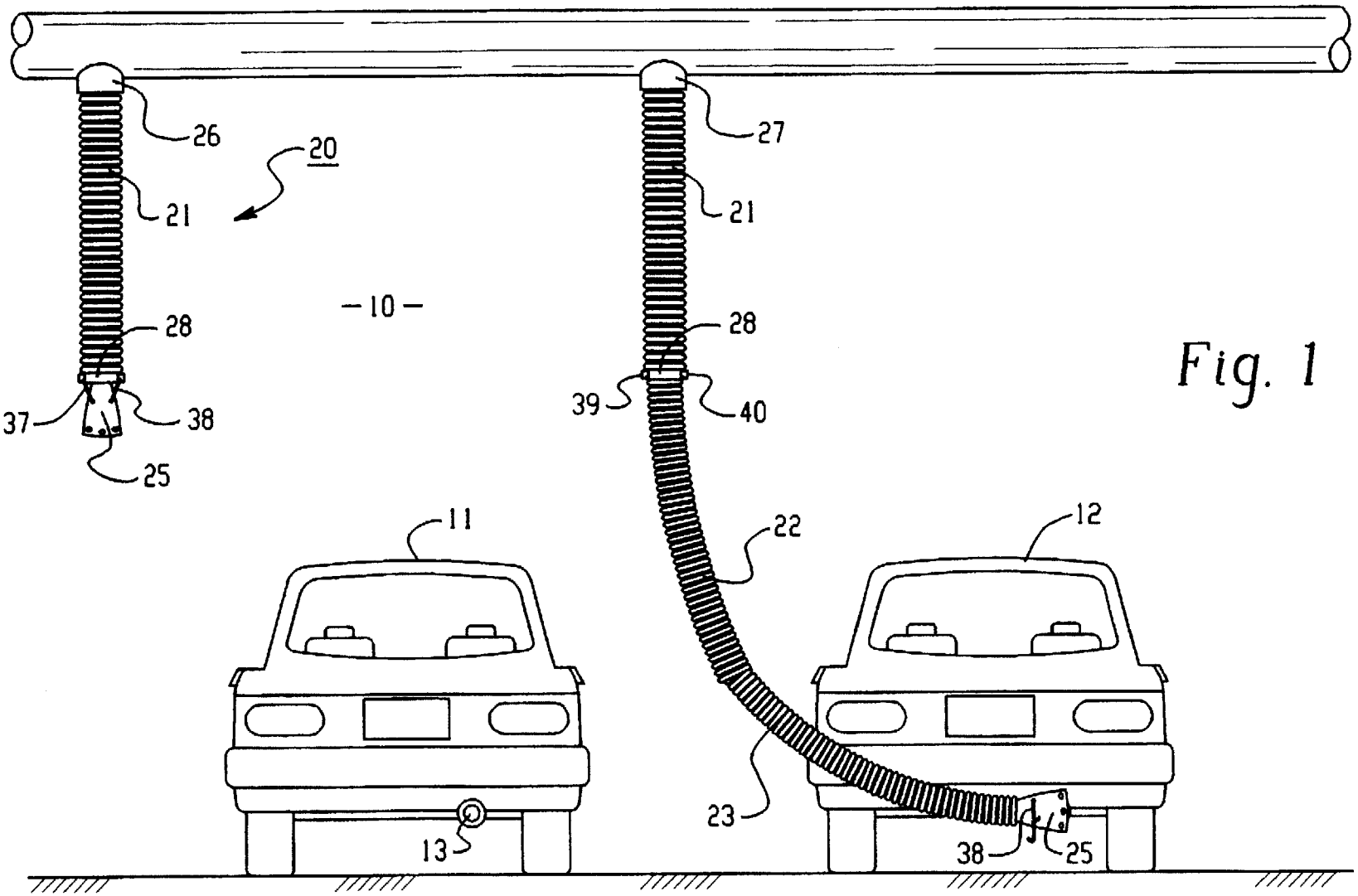
FIG. 1 is an elevational view illustrating an enclosed work space with an overhead duct system, with which the telescoping tube assembly of the invention is used.

Referring more particularly to the drawings, FIG. 1 shows an enclosed work space 10 such as a service station garage with two automotive vehicles 11 and 12 located therein for service. Each of the vehicles has a tailpipe 13, 14 through which engine combustion products are exhausted during operation of the vehicle engine. A fixed exhaust duct 15 is provided at an overhead location for use in exhausting waste gases from the enclosed space. The exhaust duct arrangement may include blowers, but in any event, it leads to an exhaust port or outlet vent through which waste gases are expelled to outside atmosphere.

Also located in the enclosed space 10 are a pair of telescoping tube assemblies 20 embodying the present invention. One of the assemblies 20 is shown in a fully retracted position and the other is shown in a fully extended position with its lower or outer end connected to the tailpipe 14 of the vehicle 12. The upper end of the assembly is connected to the overhead duct work 15 such as through a standard "T" or other type of duct work fitting.

Each of the tube assemblies 20 includes an upper tube length 21, an intermediate tube length 22 and a lower tube length 23. Each of these is a length of flexible corrugated rubber tubing provided with helical corrugations and having a generally uniform wall thickness throughout its length. The tubing may be produced, for example, in accordance with the teachings of either of U.S. Pat. Nos. 2,832,096 and 3,975,129. The methods and apparatus disclosed in those patents and the flexible helically corrugated rubber tubing produced pursuant to the methods and apparatus thereof are incorporated by reference herein.

In a typical arrangement, the upper tube length 21 has an inner diameter of about 6 in. and is 5 ft. 6 in. long. As indicated, the type of corrugated tubing referred to is axially extendable to provide an increased length if stretching is required. With that in mind, the intermediate tube length 22 has an inner diameter of about 4½ in. and a length of 5 ft. 6 in. The lower tube length 23 has an inner diameter of about 3½ in., and likewise has a length of 5 ft. 6 in.

A tailpipe adaptor 25 is secured to the outer end of the lower tube length 23 to facilitate connection of the conduit assembly to a vehicle tailpipe. The adaptor may be, for example, the adaptor shown and described in U.S. Pat. No. 4,804,019, the disclosure of which is incorporated by reference herein.

A duct connector 26 of tubular form is secured to the upper end of the upper tube length 21 for use in connecting the assembly 20 to the duct work 15. The duct connector 26 is best shown in FIG. 5A. The connector 26 may be an aluminum casting with external threads 27 formed thereon and configured to match the interior helical surface form of the upper tube length 21. Accordingly, the connector 26 may be threaded into the upper end of the tube length 21 to provide a firm airtight connection.

A rigid end fitting or lock ring 28 is connected to the lower end of the upper tube length 21. The ring 28 may also be a cast aluminum product of tubular shape with an external thread form on its exterior surface adapted to match the thread form on the interior surface of the helically corrugated tube length 21. Accordingly, the fitting or lock ring 28 may be threaded into the lower end portion of the upper tube length as shown in Fig. 5A. It will be noted that the inner diameter of the fitting 28 is sufficiently large to accommodate axial movement of the intermediate tube length 22 therethrough.

An external upper lock ring 31 which may be formed of rubber, is located on the upper end of the intermediate tube length 27 to limit the axial extension of the intermediate tube length 27 relative to the upper tube length 21. The outer diameter of the sleeve 31 is substantially greater than the inner diameter of the end fitting or lock ring 28 to assure retention of the upper end of the intermediate length within the upper tube length 21. On the other hand, the outer diameter of the fitting or lock ring 31 is sufficiently smaller than the 6' inner diameter of the tube length 21 to assure free axial movement of the intermediate tube length within the upper tube length 21.

Figure 5B:
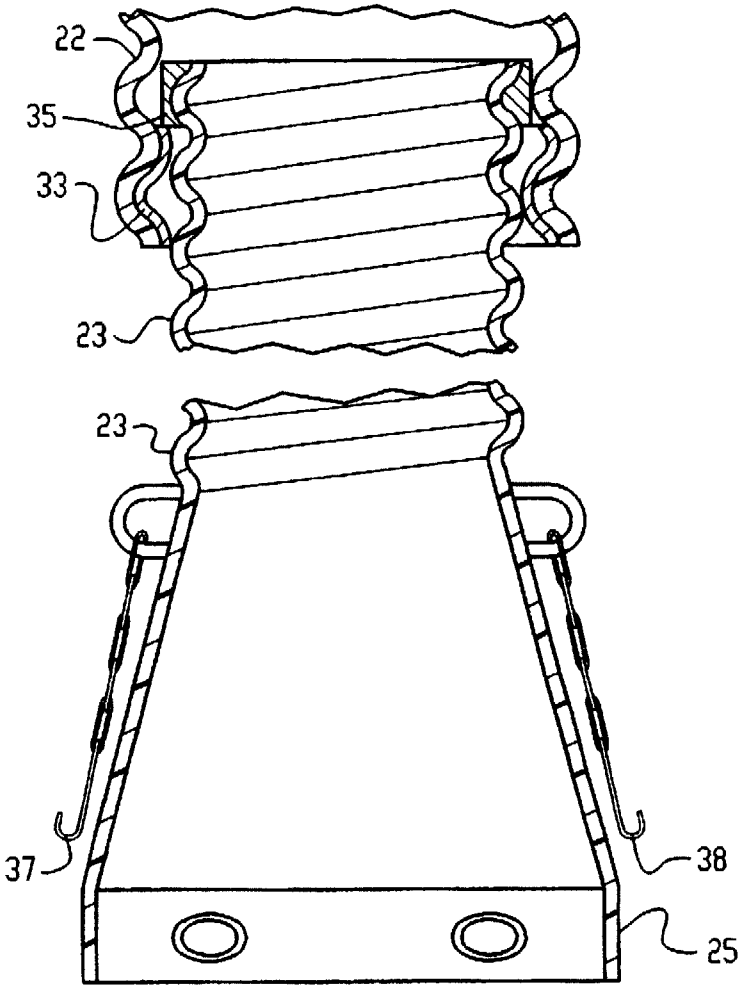
FIG. 5B is a broken sectional view of the lower portion of the telescoping tube assembly below the upper portion shown in FIG. 5A.
Figure 5A:
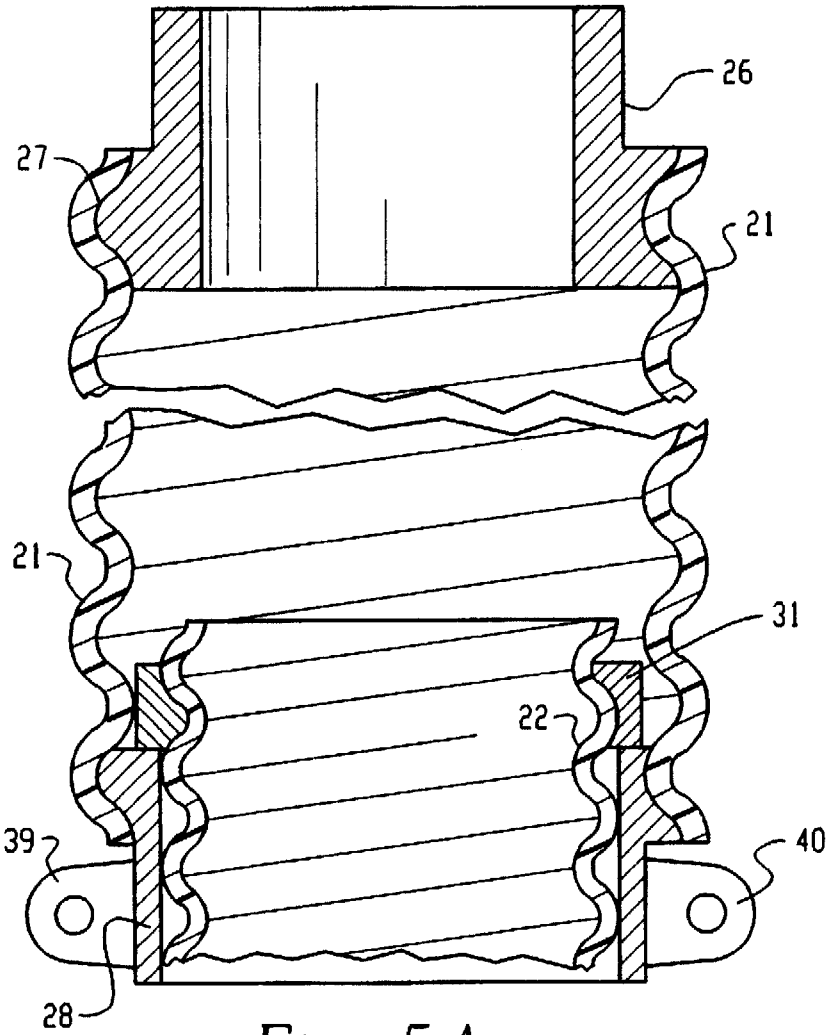
FIG. 5A is a broken sectional view of the upper portion of the telescoping tube assembly.

Another lock ring 33 with an external thread form and which may be formed of rubber, is connected to the lower end of the intermediate tube length 27 as illustrated in FIG. 5B. The lock ring 33 has an external thread form adapted to match the helical interior surface of the intermediate tube length 27. In other words, the thread form on the lock ring 33 has an outer diameter of about 4½ in. to correspond to the inner diameter of the tube length 27. The lock ring 33 may be, if desired, a length of helically corrugated tubing of uniform wall thickness, but of slightly smaller size than the tube length 27. In any event, the internal diameter of the lock ring 33 is sufficiently large to permit free axial movement of the lower tube length 33 therethrough. This clearance is illustrated in FIG. 5B.

Still another lock ring 35 is received on the upper end of the lower tube length 23. This lock ring may have internal threads formed thereon to match the external thread form of the lower tube length 23, or may merely be a sleeve of cylindrical form that is force fitted over the end of the lower tube length 23 and secured with adhesive as a matter of convenience. In any event, the outer diameter of the lock ring 35 is sufficiently less than the inner diameter of the intermediate tube length 22 that free axial movement of the lower tube length 23 is accommodated.

Figure 2:
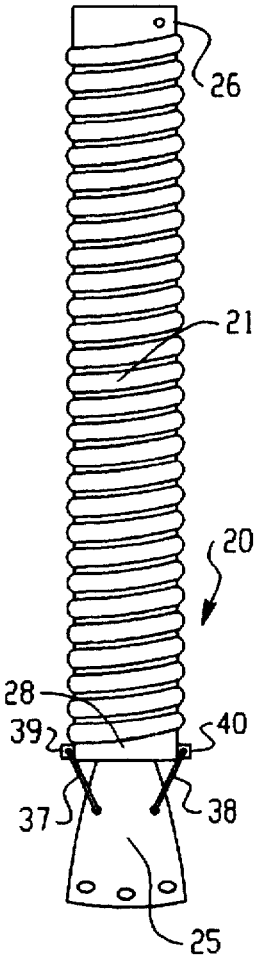
FIG. 2 is an elevational view of the telescoping tube assembly of the invention in its retracted position.
Figure 3:
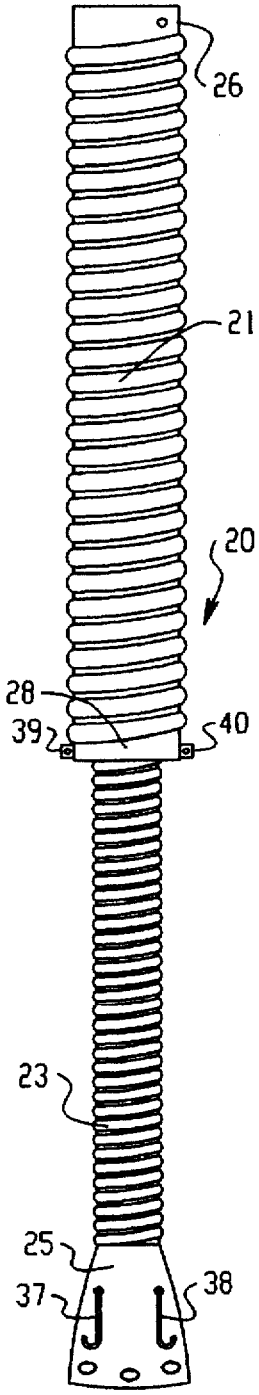
FIG. 3 is an elevational view showing the telescoping tube assembly of the invention in a partially extended position.

FIG. 5B illustrates the means for connecting the tailpipe adaptor 25 to the lower end of the lower tube length 23. It should be noted that a pair of swivel-mounted hooks 37 and 38 are provided on the adaptor 25 and these are adapted to connect to latch rings 39 and 40 formed in the rigid end fitting 28 located at the lower end of the upper tube length 21. These hooks are for the purpose of retaining the telescoping tube assembly 20 in its retracted position (FIGS. 1 and 2) when not in use.

Figure 4:
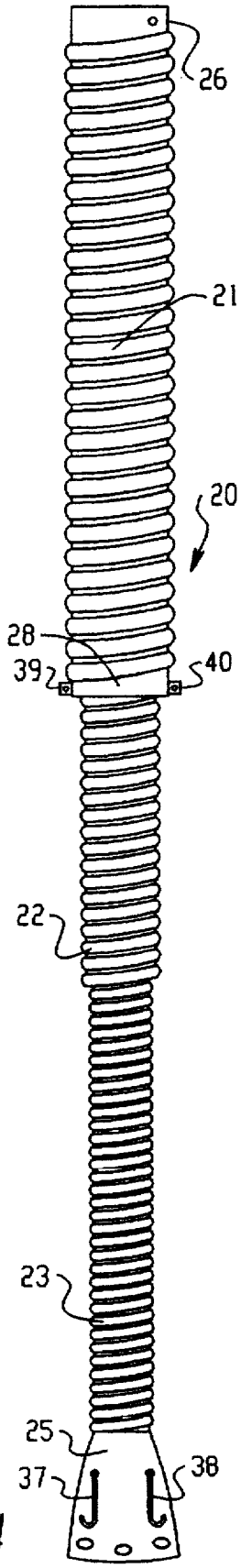
FIG. 4 is an elevational view of the telescoping tube assembly of the invention showing the assembly in its fully extended position.

As will be apparent, the tube assembly 20 and its unique design permit movement from the retracted position illustrated in the left hand portion of FIG. 1 to a fully extended position illustrated in both FIGS. 1 and 4. This arrangement produces an extended length for the assembly of about 17 ft. Some of the extension may be accommodated by the flexible and extendible nature of the helically corrugated tube lengths 21, 22 and 23. However the major part of the extension is afforded by the telescoping movement of the tubes 21, 22 and 23.

Also, in view of the flexibility of the assembly it may be moved to any number of positions as desired within a relatively large area. Also, it will be noted that the tubing thus described is crush resistant, so that it will be unlikely that the path through which the waste gases flow from the vehicle tailpipe to the overhead conduit structure 15 would be blocked at any time.

While the invention has been shown and described with respect to a specific embodiment thereof, other variations and modifications of the specific device herein shown and described will be readily apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

I claim:

1. Apparatus for exhausting vehicle engine combustion products from an enclosed space to outside atmosphere through an overhead duct structure comprising;

an extensible tube assembly adapted to be suspended in said enclosed space and having an upper end operatively connected to said overhead duct structure, said assembly being adapted for telescoping movement between a retracted position, and an extended position wherein the lower end of said assembly may be connected to a vehicle engine exhaust pipe said assembly having, at least two lengths of flexible, helically corrugated tubing including a first tube length and a second tube length adapted to be telescopingly received within said first tube length, each tube length having an upper end and a lower end, a first lock ring member having external threads, and being threadedly received within the lower end of said first tube length, said second tube length being freely movable axially therethrough, a second lock ring member having internal threads and being threadedly received around the upper end of said second tube length above said first lock ring member, said second lock ring member being freely movable axially within said first tube length, said lock ring members being adapted to prevent separation of said first tube length from said second tube length during telescoping movement of said tube assembly to said extended position, and means for securing said tube assembly in said retracted position.

2. Apparatus as defined in claim 1, wherein said extensible tube assembly comprises three lengths of flexible, helically corrugated tubing including upper, intermediate and lower tube lengths, said lower tube length being telescopingly received in said intermediate tube length and said intermediate tube length being telescopingly received in said upper tube length.

3. Apparatus as defined in claim 1, wherein at least one of said lock ring members is formed of flexible, helically corrugated tubing of uniform wall thickness.

4. Apparatus as defined in claim 1, wherein said tube lengths are formed of rubber and have a generally uniform wall thickness.

5. Apparatus for exhausting vehicle engine combustion products from an enclosed space to outside atmosphere through an overhead duct structure comprising;

an extensible tube assembly adapted to be suspended in said enclosed space and having an upper end operatively connected to said overhead duct structure, said assembly being adapted for telescoping movement between a retracted position, and an extended position wherein the lower end of said assembly may be connected to a vehicle engine exhaust pipe, said assembly having, three lengths of flexible, helically corrugated tubing including an upper tube length, an intermediate tube length and a lower tube length, said lower tube length being telescopingly received in said intermediate tube length and said intermediate tube length being telescopingly received in said upper tube length, an upper lock ring assembly operatively associated with said upper and intermediate tube lengths, a lower lock ring assembly operatively associated with said intermediate and lower tube lengths, said upper lock ring assembly including:

a first annular ring member formed of rigid metal and having external threads adapted to be threadedly received within the lower end of said upper tube length, and a second annular ring member having internal threads threadedly received around the upper end of said intermediate tube length and located above said first annular ring member, said second annular ring member being freely movable axially within said upper tube length, said lower lock ring assembly including:

a third annular ring member having external threads adapted to be threadedly received within the lower end of said intermediate tube length, and a fourth annular ring member having internal threads threadedly received around the upper end of said lower tube length and located above said third annular ring member, said fourth annular ring member being freely movable axially within said intermediate tube length, said lock ring assemblies being adapted to prevent separation of said lengths during telescoping movement of said tube assembly to said extended position, and means for securing said tube assembly in said retracted position.

6. Apparatus as defined in claim 5, wherein at least one of said lock ring members is formed of flexible, helically corrugated tubing of uniform wall thickness.

7. Apparatus as defined in claim 5, wherein said tube lengths are formed of rubber and have a generally uniform wall thickness.

8. Apparatus as defined in claim 5, wherein said means for securing said tube assembly in said retracted position comprises a pair of radially extending circumferentially spaced brackets located on and extending radially outwardly from said first annular ring member and a pair of hooks located at the lower end of said lower tube length and adapted to be connected to said brackets when said tube assembly is in said retracted position.

* * * * *